US006554223B1

(12) United States Patent
Kistner et al.

(10) Patent No.: US 6,554,223 B1
(45) Date of Patent: Apr. 29, 2003

(54) APPARATUS AND A METHOD FOR ALIGNING A WEB

(75) Inventors: Jerome L. Kistner, Cleves, OH (US); Gerard C. Fournier, Oakdale, LA (US); Brian J. Reilly, Cincinnati, OH (US); Todd J. Statt, Kings Mill, OH (US); Paul G. Tiettmeyer, Harrison, OH (US); Curtis H. Van Valkenburgh, Milford, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/542,163

(22) Filed: Apr. 4, 2000

(51) Int. Cl.[7] ..... B65H 23/04
(52) U.S. Cl. ..... 242/615.21; 226/196.1
(58) Field of Search ..... 226/196.1, 88; 242/613.21, 615.1

(56) References Cited

U.S. PATENT DOCUMENTS

| | | | | | |
|---|---|---|---|---|---|
| 2,496,312 | A | * | 2/1950 | Robertson | 264/195 |
| 2,660,218 | A | | 11/1953 | Johnson et al. | |
| 2,968,856 | A | * | 1/1961 | Allen | 26/51.6 |
| 2,989,265 | A | | 6/1961 | Selsted | |
| 3,087,663 | A | | 4/1963 | Anderson | |
| 3,171,579 | A | * | 3/1965 | Robertson | 226/23 |
| 3,207,018 | A | | 9/1965 | Rauenbuehler | |
| 3,402,443 | A | * | 9/1968 | Leitner et al. | 226/196.1 |
| 3,592,371 | A | * | 7/1971 | Wyatt | 28/282 |
| 3,606,120 | A | | 9/1971 | Wyatt et al. | |
| 3,660,867 | A | | 5/1972 | Watson | |
| 3,664,561 | A | | 5/1972 | Feiertag | |
| 3,693,855 | A | | 9/1972 | Bonner | |
| 3,763,520 | A | * | 10/1973 | Izawa et al. | 226/1 |
| 3,912,145 | A | | 10/1975 | Meihofer | |
| 4,243,167 | A | | 1/1981 | Sander | |
| 4,335,857 | A | * | 6/1982 | Pfost et al. | 242/346.2 |
| 4,360,356 | A | | 11/1982 | Hall | |
| 4,410,122 | A | * | 10/1983 | Frye et al. | 242/615.2 |
| 4,453,659 | A | | 6/1984 | Torpey | |
| 4,521,007 | A | | 6/1985 | Darda | |
| 4,534,498 | A | | 8/1985 | Nilsson | |
| 4,573,670 | A | | 3/1986 | Felix | |
| 4,763,852 | A | | 8/1988 | Smith | |
| 4,889,269 | A | * | 12/1989 | Long et al. | 242/615.12 |
| 4,901,903 | A | | 2/1990 | Blanding | |
| 4,991,761 | A | | 2/1991 | Gnuechtel et al. | |
| 4,998,117 | A | | 3/1991 | Shibuya et al. | |
| 5,074,450 | A | | 12/1991 | Lindner et al. | |
| 5,087,318 | A | | 2/1992 | Anderson | |
| 5,388,513 | A | * | 2/1995 | Ohta | 101/228 |
| 5,664,738 | A | | 9/1997 | Fife | |

FOREIGN PATENT DOCUMENTS

| | | | | | |
|---|---|---|---|---|---|
| JP | 55-115546 | A | * | 9/1980 | 226/196.1 |

* cited by examiner

*Primary Examiner*—Donald P. Walsh
*Assistant Examiner*—Joseph Rodriguez
(74) *Attorney, Agent, or Firm*—Michael S. Kolodesh; Jay A. Krebs; Ken K. Patel

(57) ABSTRACT

An apparatus and method for aligning a continuous web of material with an entry point of a machine that utilizes the web as a source material. The web may include pre-processed materials that may be thicker than conventional webs and/or have uneven thickness, and/or are susceptible to excessive compression forces and/or tensions which may be found in ordinary straight-wound rolls. Such pre-processed materials may be wound in traverse-wound rolls or festooned into a container forming a web source structure which is wider than the web width. The web is pulled from such web source structure by the machine through a series of guides which include surfaces having various properties and shapes to create tensions in the web and to align the web with the entry point of the machine.

13 Claims, 15 Drawing Sheets

APPARATUS AND A METHOD FOR ALIGNING A WEB

FIELD OF THE INVENTION

The present invention relates to a web handling system and in particular to an apparatus and a method for feeding a continuous web from a roll or a box or other web storage means to an entry point of a machine that utilizes the web as source material. More particularly, the invention relates to an apparatus and a method for aligning to an entry point of a converting line a continuous web from a roll or a box or other web storage means wherein at least some of web layers are not aligned with each other, but are off-set or overlapped laterally to form a width of the web storage means that is wider than the web width.

BACKGROUND OF THE INVENTION

It has been conventional practice in manufacturing disposable absorbent products, such as diapers, sanitary napkins, etc., to supply converting lines with source materials, such as plastic film webs and non-woven webs, in a form of straight-wound rolls wherein layers of web are wound on a core substantially perpendicular to the core axis of rotation. Therefore, straight-wound rolls usually provide webs that are in a well aligned condition. Feeding these web from straight-wound rolls into converting lines often involves some type of unwinding apparatus generally used in the art to unwind the web from the roll at a controlled web velocity and tension. However, modern source materials that may be used on converting lines often cannot be fed by conventional means because the modern source materials may not be suitable for winding onto straight-wound rolls.

Modern source materials may be more complex than conventional webs and may include various product elements incorporated into conventional webs. For example, modern source materials for disposable absorbent articles, may include fastening tapes, side panels, cuffs, core components, waist strips and/or other product elements attached to a carrying web. Also, modern source materials may include various modifications of the web surface(s) affecting the thickness and/or surface texture of the web, for example, embossing, selfing, slitting, etc. Further, modern source materials may include various lines of weakness, for example, perforations, channels, etc., to enable subsequent splitting of the web into separate parts along the lines of weakness during converting and/or tearing the final product along the lines of weakness by a consumer. Also, modern source materials are often pre-fabricated off converting lines in order to maintain or reduce the number of process operations on converting lines which can increase the cost of production and the cost of new product upgrades.

As a result of the complexity related to such modern source materials, the pre-fabricated materials may be considerably thicker than conventional webs, and/or have uneven thickness, shape and strength properties. The thickness and/or texture of pre-fabricated materials may be susceptible to compression forces that may be found inside of ordinary wound rolls and which may result in irreversible damage to the material. Further, the lines of weakness which may be present in pre-fabricated materials may be susceptible to tensions that may cause the material to tear along the lines of weakness at inappropriate times. These problems can make prefabricated materials less suitable for winding onto rolls and, particularly, for winding onto straight-wound rolls. Although some of the possibly damaging forces can be reduced or controlled by limiting the length of material wound on a roll (because larger rolls have usually higher compression forces), such a reduction will also reduce the period of time between roll changes on a converting line. Consequently, the cost associated with providing uninterrupted supply of the material to the converting line will increase.

One alternative to straight-roll winding is traverse winding of rolls, wherein a web is wound not perpendicularly to the axis of rotation but in layers across the width of the roll forming a web source structure that is wider than the web width. Each consecutive layer may be wound on top of the preceding layer in a direction which is opposite to the lateral direction of winding of the preceding layer. The turns of material may be off-set laterally in relation to each other or overlapped laterally. Because the traverse-wound rolls may provide a desired length of web at reduced outside diameters of web on the roll than straight-wound rolls holding the same length of web, many of the negatives described above can be avoided. However, because the web on the traverse-wound roll is not aligned perpendicularly to the core axis, the web does not unwind into an aligned web path which extends between the core and the entry point of the converting line. Instead, the web unwinds laterally across the core forming web paths which are not aligned to the entry point of the converter. The degree of misalignment of the web may prevent the use of conventional means for aligning the web.

Another alternative to straight winding is festooning into a container. For example, the continuous web may be folded back and forth within the container. In some case it may be most economical or practical to festoon the web such that the folds are off-set laterally along the width of the container forming a web source structure that is wider than the web width. Like the turns of the web in traverse-wound rolls, the festoon folds may be spaced apart laterally in relation to each other or overlapped laterally. However, contrary to the roll-wound web, either straight-wound or traverse-wound, the festooned web may be subjected to little or no tension. This characteristic of festooning can make festooning suitable for storing webs that are susceptible to excessive compression forces and/or excessive tensions that may be present in the wound rolls.

Festooning may be also beneficial for webs which may be difficult to splice automatically between roll changes. Festooning enables the web to be spliced manually by attaching the end of the web from a first festooned container to the beginning of the web from a second festooned container. The containers can be disposed adjacent to each other.

However, the festooned web arranged laterally in a wide container may present problems. One problem, as it was described above for the traverse-wound rolls, may relate to relatively significant misalignment between the web paths exiting the festooned container toward the entry point of the converter. Another problem may relate to the festooned web having little or no tension and may require introduction of a tension force in the web in order to make the web manageable for alignment with the entry point of the converting line.

Accordingly, it would be desirable to provide an apparatus and a method for aligning to an entry point of a converting line a web which is stored in a web source structure that is wider than the web width. It would also be desirable to provide an apparatus and a method for aligning to an entry point of a converting line a web which is stored in a web source structure wherein at least some of the web layers are off-set laterally in relation to each other or overlapped laterally. It would also be desirable to provide an apparatus and a method for aligning to an entry point of a converting line a web which is stored in a web source structure wherein the web is subjected to little compression forces. It would also be desirable to provide an apparatus and a method for aligning to the entry point on the converting line a web which is stored in a web source structure wherein the web is subjected to little or no tension.

SUMMARY OF THE INVENTION

The present invention provides an apparatus and a method for aligning a continuous web with a point of entry of a machine adapted to accept the web. The point of entry has a machine centerline and the web has a web width, a longitudinal centerline, a first surface and a second surface. The apparatus includes an input guide having an input guide outer surface which is situated to intersect a web extending from a web source structure toward the entry point of the machine. The input guide outer surface is wrapped at least partially by the first surface of the web when in use. The apparatus further includes a centering guide having a centering guide concave portion which is situated to intersect with the web extending from the input guide toward the entry point of the machine. The centering guide concave portion is wrapped at least partially by the second surface of the web when in use. The apparatus further includes an output guide having an output guide concave portion which is situated to intersect with the web extending from the centering guide toward the point of entry of the machine. The output guide concave portion is wrapped at least partially by the first surface of the web when in use.

DETAILED DESCRIPTION OF THE INVENTION

The invention relates to an apparatus and a method for aligning to an entry point of a converter a continuous web from a roll, a container or other web source structures wherein at least some of web layers are not aligned with the entry point of a converter. More particularly, the apparatus of the present invention may be useful for processing continuous webs of pre-processed materials which may be considerably thicker than conventional webs, and/or have uneven thickness, and/or are susceptible to excessive compression forces and/or tensions. In such cases, the web source structure often has a width that is wider than the web width. Examples of such web source structures include a traverse-wound roll 5 shown in FIG. 1 and a festoon 10 shown in FIG. 2.

Figure 1:
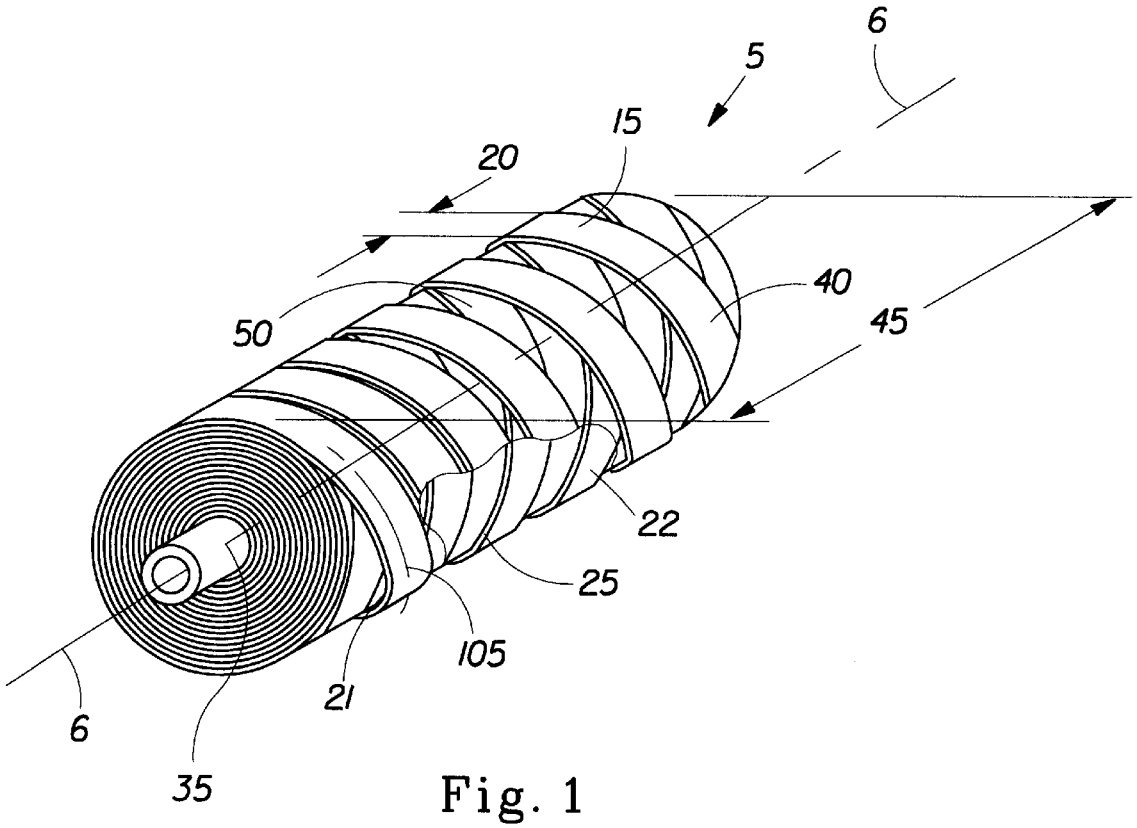
FIG. 1 is a simplified perspective view of a web wound onto a traverse-wound roll.

In the traverse-wound roll 5 of FIG. 1, a web 15, which has a web width 20, a longitudinal centerline 105, a first surface 21 and a second surface 22, may be wound about a core 35, forming layers 25 comprising turns 40 of the web which may be off-set laterally in relation to each other or overlapped laterally. It should be noted that the turns 40 in each layer 25 can be off-set, overlapped or in any orderly or random combination of the above. Each subsequent layer 25 may be wound in opposite directions across the roll from the preceding layer, thus, forming a crosswise configuration 50 of layers 25. The width 45 of the traverse-wound roll 5 is defined by the width of the lateral distribution of the web 15 on the core 35. Accordingly, the traverse-wound roll width 45 may be larger than the web width 20.

Figure 2:
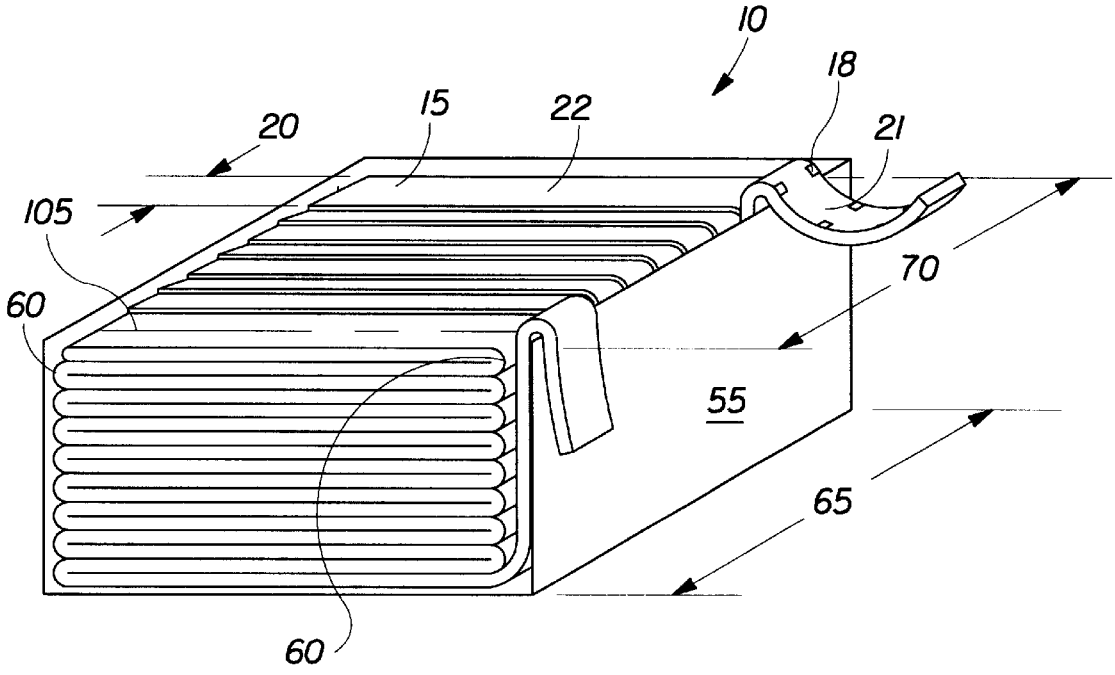
FIG. 2 is a simplified perspective view of a web festoon in a container.

Referring to FIG. 2, the festoon 10, can be formed by folding the web 15, which has a web width 20, a longitudinal centerline 105, a first surface 21 and a second surface 22, back and fourth into a container 55. The length of web 15 between folds 60 may be laid down in any fashion including being spaced at least partially laterally within container width 65 to form a festooned formation width 70. Like turns 40 of the traverse-wound roll 5 of FIG. 1, the length of web 15 between the folds 60 of the festoon 10 can be off-set laterally in relation to each other or overlapped laterally, or they can be laid in any orderly or random configuration. Accordingly, the festoon formation width 70 may be larger than the web width 20.

Figure 3:
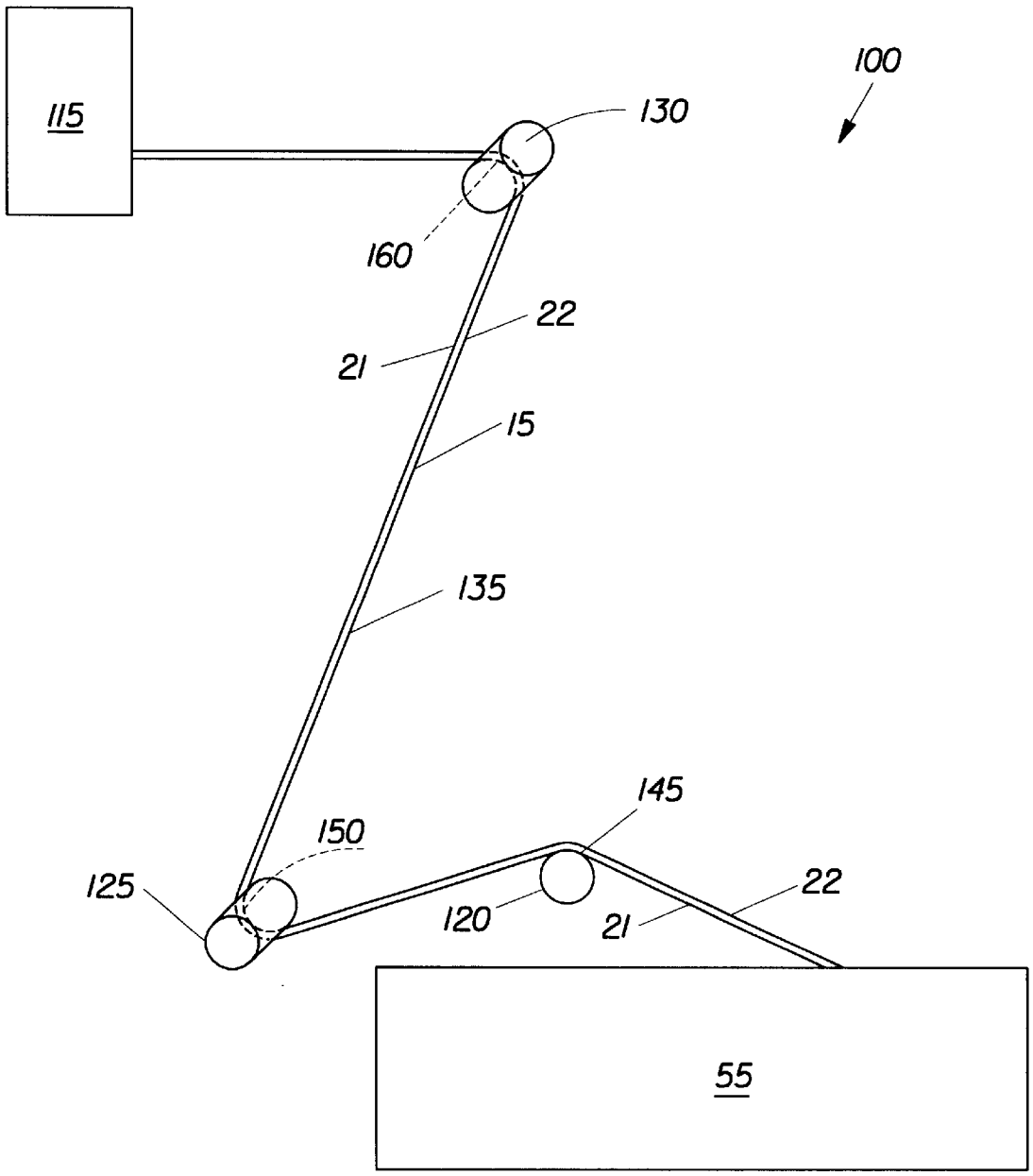
FIG. 3 is a simplified side elevational view of one embodiment of the present invention showing three guides and a festooned container.
Figure 4:
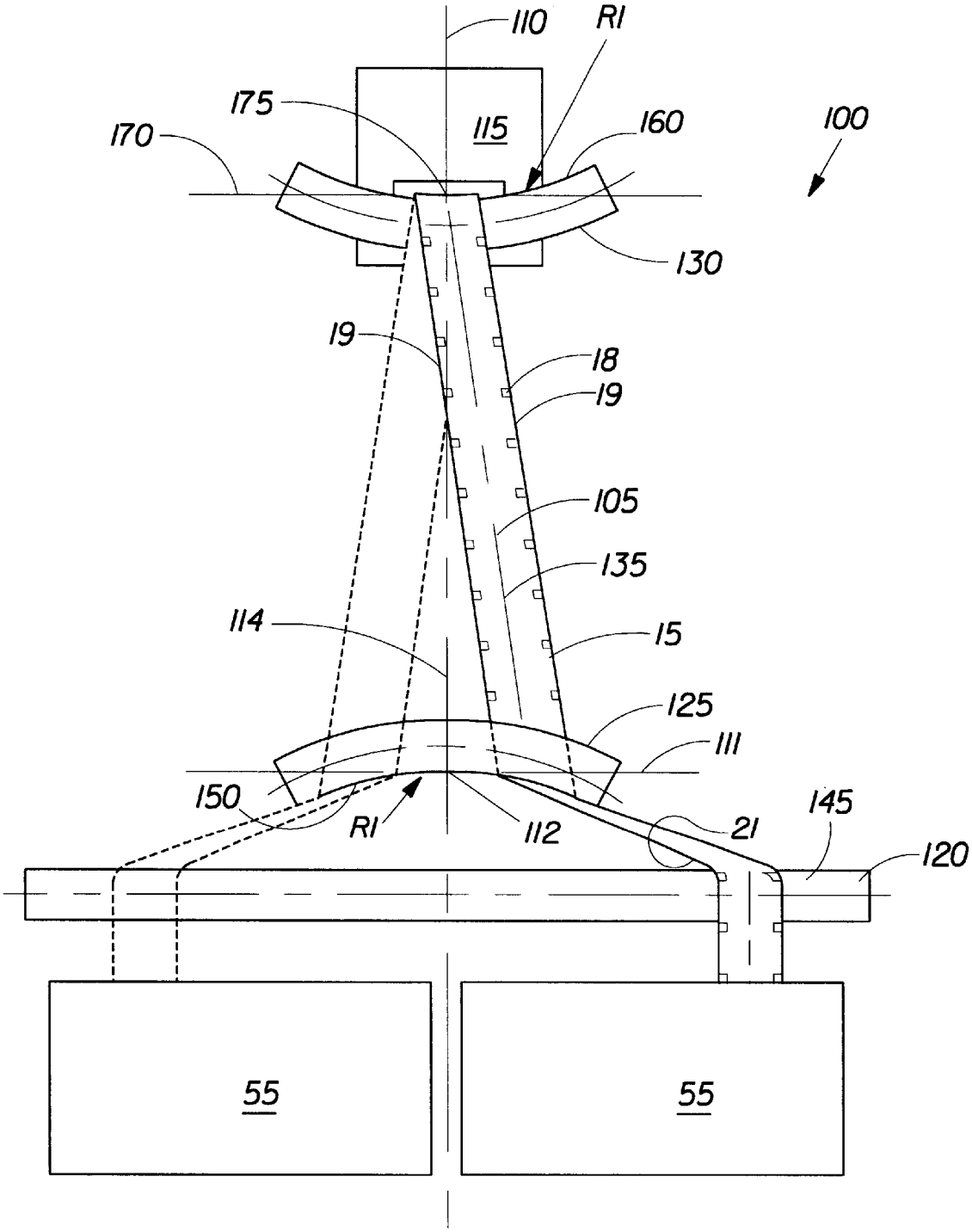
FIG. 4 is a simplified front elevational view of the embodiment shown in FIG. 3.
Figure 5:
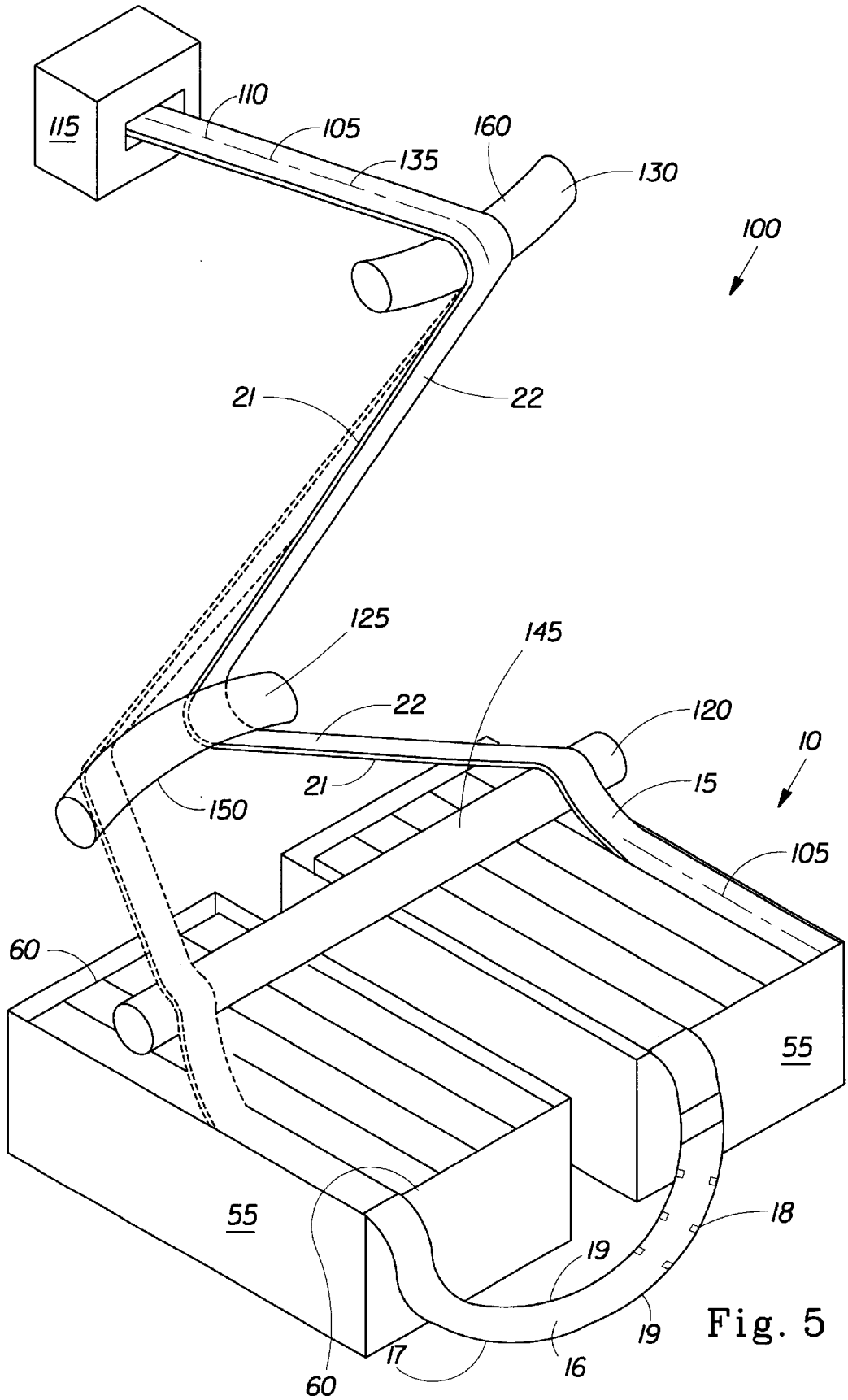
FIG. 5 is a simplified perspective view of the embodiment shown in FIGS. 3–4.
Figure 6:
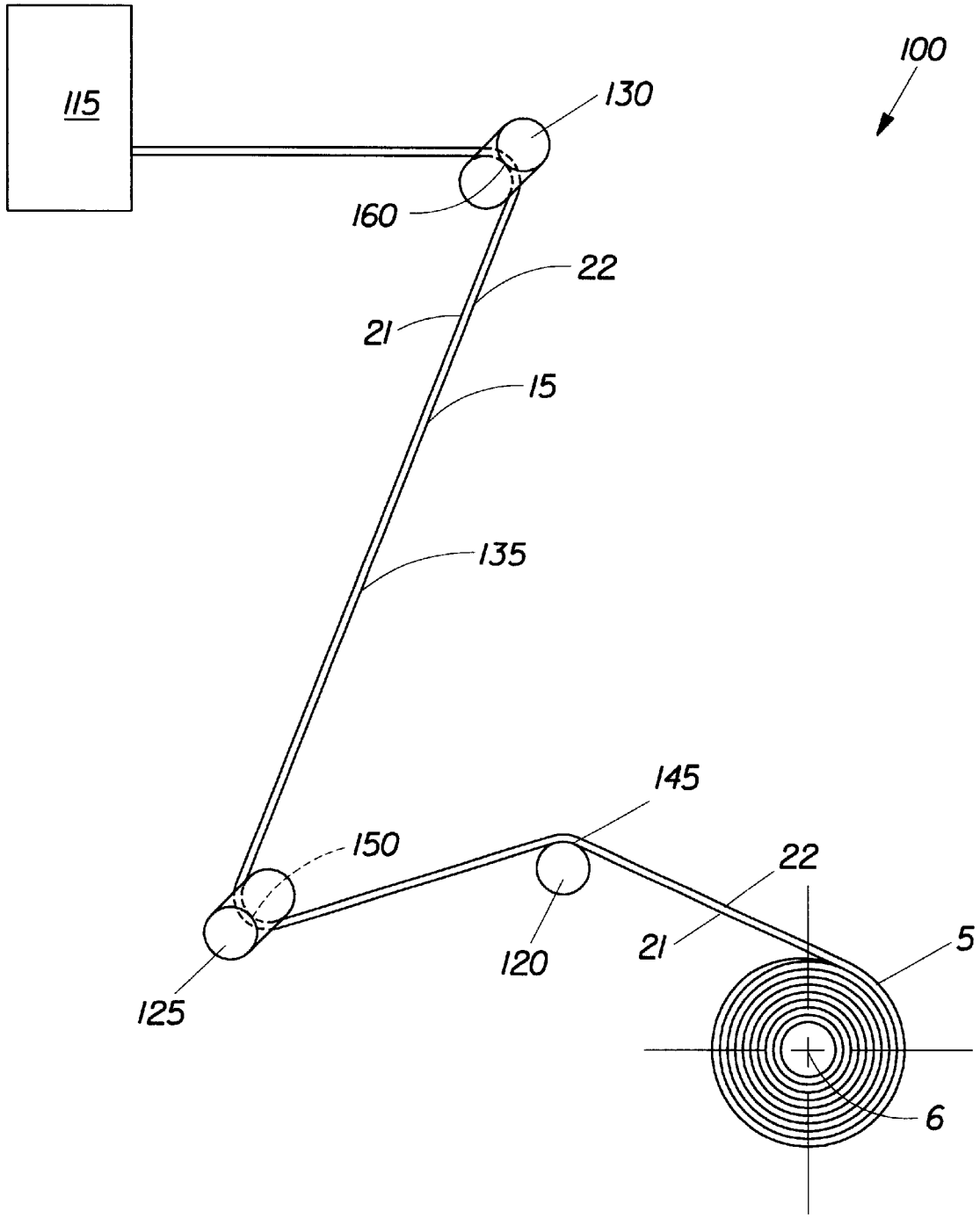
FIG. 6 is a simplified side elevational view of the embodiment of FIGS. 3–5 showing a traverse-wound roll.
Figure 7:
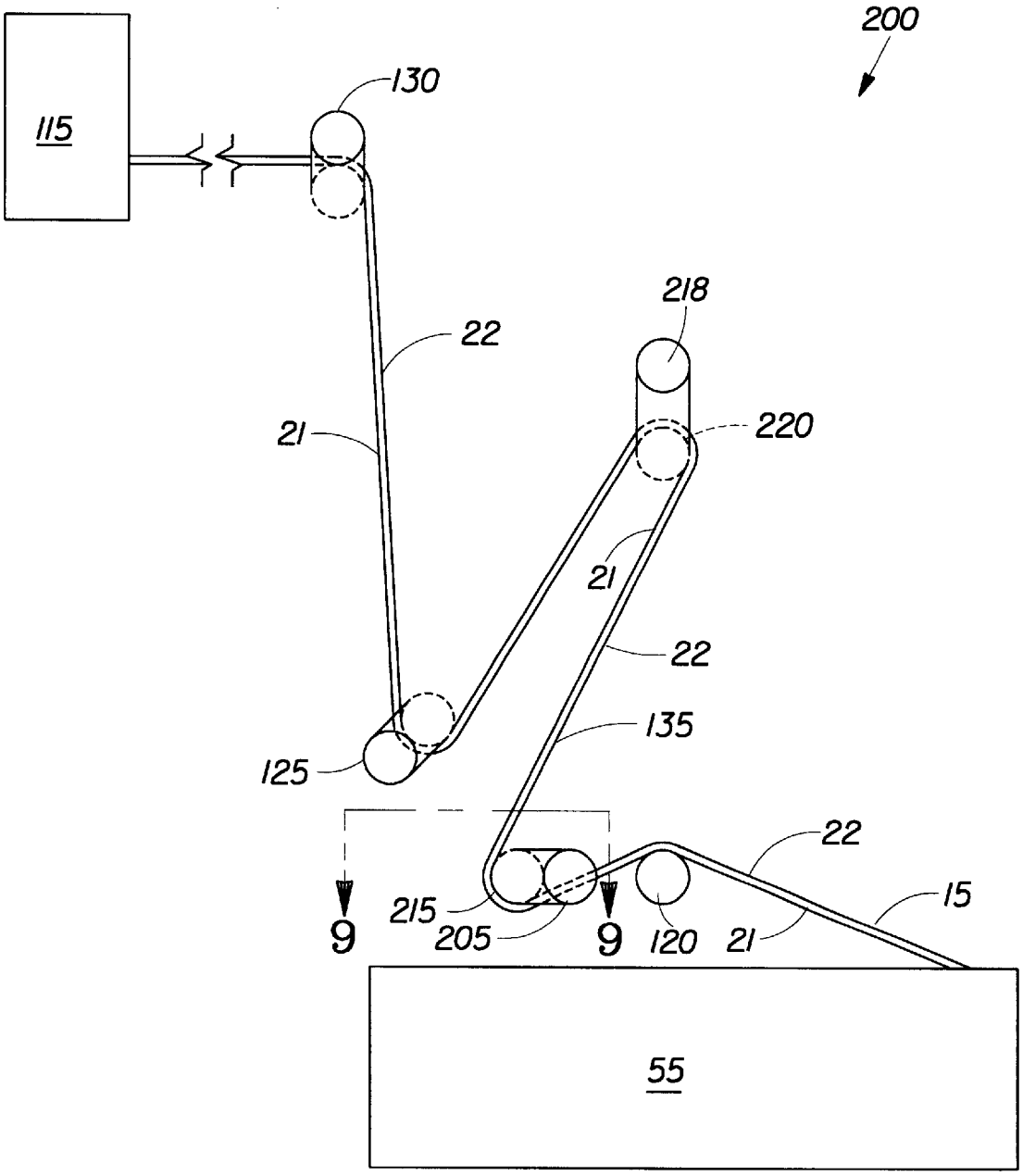
FIG. 7 is a simplified side elevational view of another embodiment of the present invention showing five guides.

FIGS. 3–5 show a side view, a front view and a perspective view, respectively, of one embodiment of an apparatus 100 of the present invention working with festoon containers 55. FIG. 6 show the apparatus 100 working with a traverse wound roll 5. In both cases, the apparatus 100 aligns a longitudinal centerline 105 of the web 15 with a machine centerline 110 of an entry point 115. The web 15 can be any continuous web, such as plastic films, non-woven substrates, scrims, foams, rubber, metal foils, or other materials, either separately or in a combination. For example, as is shown in FIGS. 3–5, the web 15 may be a laminate material comprising webs 16 and 17 and thicker parts 18 (e.g., fastening tapes or other product elements) disposed adjacent to opposing longitudinal edges 19 of the web 15. In certain embodiments related to production of is disposable absorbent articles, the width of the web 15 may be in the range of about 0.5 inches (12.7 mm) to about 15 inches (381 mm). In one particular embodiment used herein as an example to better describe the invention, the width of the web 15 may be about 6 inches (152 mm).

The web 15 may be pulled from a festooned container 55 or from an array of containers 55 which may be arranged in various fashions in relation to each other. One example of an arrangement of two festooned containers 55 shown in a side-by-side arrangement transverse to the point of entry 115 shown in FIGS. 4–5. In this case, the web 15 of first container can be easily spliced manually with the web from second container because both ends of the web 15 are exposed, as shown in FIG. 2. Thus, utilizing festooned cartons, rather than wound rolls, can save on the cost of having automatic splicing capability which is needed for changing an expiring roll with a new roll in order to ensure an uninterrupted supply of the web material.

The web 15 can be discharged from the festooned container 55 or the traverse-wound roll 5 by any device capable of pulling the web, for example, a nip or any metering device used in the art which may be adapted on a converter to pull the web 15 through the entry point 115. Prior to the entry point 115, the web 15 is guided through a series of guides 120, 125 and 130 which are disposed to intersect with a web path 135, extending between the container 55 and the entry point 115, to create appropriate tensions and aligning effects in the web 15.

Input guide 120 may be disposed adjacent to the festooned container 55 (as shown in FIGS. 3–5) or the traverse-wound roll 5 (as shown in FIG. 6) and is designed to accept the web 15, which may be under little or no tension prior to entering the input guide 120. Input guide 120 is preferably positioned generally parallel to folds 60 of the web 15 of the festoon 10 or generally parallel to a rotational axis 6 of the traverse-wound roll 5. The first surface 21 of the web 15 is preferably wrapped around an input guide outer surface 145 which creates a frictional force between the fist surface 21 and the input guide outer surface 145 when the web 15 moves past the input guide 120. The frictional force resists the force pulling the web 15 into the entry point of the converter and thereby creates a tension force directed away from the entry point. The tension force may be useful for handling of the web 15.

The input guide outer surface 145 may be any suitable surface capable of creating a desired frictional force with the web 15, and the input guide outer surface 145 may include various plastics, metals, plastic or metal coatings or combinations thereof. Further, the input guide outer surface 145 may be smooth or may include various protrusions, depressions or other surface modifications imparted physically, chemically, electrically, either separately or in a combination. The input guide outer surface 145 may also include apertures and/or slits for creating a negative and/or positive pressure between the web 15 and the input guide outer surface 145. Still further, the input guide outer surface 145 may have a cross-section that may be of any shape, including but not limited to round, triangular, square or other multi-sided shapes.

Input guide 120 can be of any length generally positioned suitable to accept the web 15 from the opposite sides of the width of the web source structure. Further, any part of the input guide 120 may be hollow or solid, and the input guide 120 may be attached to a suitable frame by any suitable means. In one exemplary embodiment, as is shown in FIGS. 3–6, the input guide 120 may comprise a 6 inch (152 mm) PVC pipe which is about 68 inches long (1727 mm).

The apparatus 100 of the present invention preferably also includes the centering guide 125 (shown in FIGS. 3–6) which is designed to accept the web 15 after it passes the input guide 120 and to provide alignment between the longitudinal centerline 105 of the web 15 and the machine centerline 110 of the entry point 115. At least a portion of the centering guide 125 has a centering guide concave portion 150. The location of the centering guide 125 can be varied with respect to the input guide 120 and it can be anywhere in the web path 135 as long as the centering guide concave portion 150 is at least partially wrapped around by the second surface 22 of the web 15 and acts to guide the web 15 toward the entry point 115 of the converting line. Preferably, as shown in FIGS. 3–6, the centering guide 125 is positioned to intercept with the vertical projection 114 (best shown in FIG. 4) of the machine centerline 110 such that a tangent 111 to the centering guide concave portion 150 at a point 112 of intersection of the centering guide concave portion 150 with the vertical projection 114 of the machine centerline 110, is perpendicular to the vertical projection 114.

The makeup of the centering guide concave portion 150 can be similar in all or any aspects to the input guide outer surface 145 described in detail above. As with the input guide outer surface 145, the frictional force created between the second surface 22 of the web 15 and the centering guide concave portion 150 may be useful to create a tension force in the web 15 extending between the input guide 120 and the centering guide 125. Further, it should be noted that any part of the centering guide 125 may be hollow or solid, and the centering guide 125 may be attached to a suitable frame by any suitable means. In the embodiment shown in FIGS. 3–6, when the web width is about 6 inches (152 mm), it has been found that a centering guide 125 made from a 5 inch (127 mm) PVC pipe having a concave portion 150 at a radius R1 of about 700 mm to about 1000 mm and preferably of about 850 mm works well. The radius R1 can be also expressed as a percentage of the web width. For example, for a web width of about 152 mm, the radius R1 may be from about 460 percent to about 660 percent of the web width, and preferably, about 560 percent of the web width.

The apparatus 100 of the present invention preferably also includes output guide 130 which is designed to accept the web 15 as it passes after the centering guide 125 to provide further alignment between the longitudinal centerline 105 of the web 15 with the machine centerline 110 of the entry point 115. Similar to the centering guide 125, the output guide 130 includes an output guide concave portion 160. The first surface 21 of the web 15 is preferably wrapped around the output guide concave portion 160 to create a frictional force between the first surface 21 and the output guide concave portion 160 which can create a tension force in the web 15 extending between the centering guide 125 and the output guide 130. The location of the output guide 130 can be varied vertically with respect to the centering guide 125 and the entry point 115 of the converter. In one preferred embodiment, as shown in FIGS. 3–6, the output guide 130 is positioned to intersect with the vertical projection 114 (best shown in FIG. 4) of the machine centerline 110 such that a tangent 170 to the output guide concave portion 160 at a point 175 of intersection of the output guide concave portion 160 with the vertical projection 114 of the machine centerline 110, is perpendicular to the vertical projection 114. The output guide 130 can be similar in all or any aspects to the centering guide 125 which is described in detail above.

Figure 8:
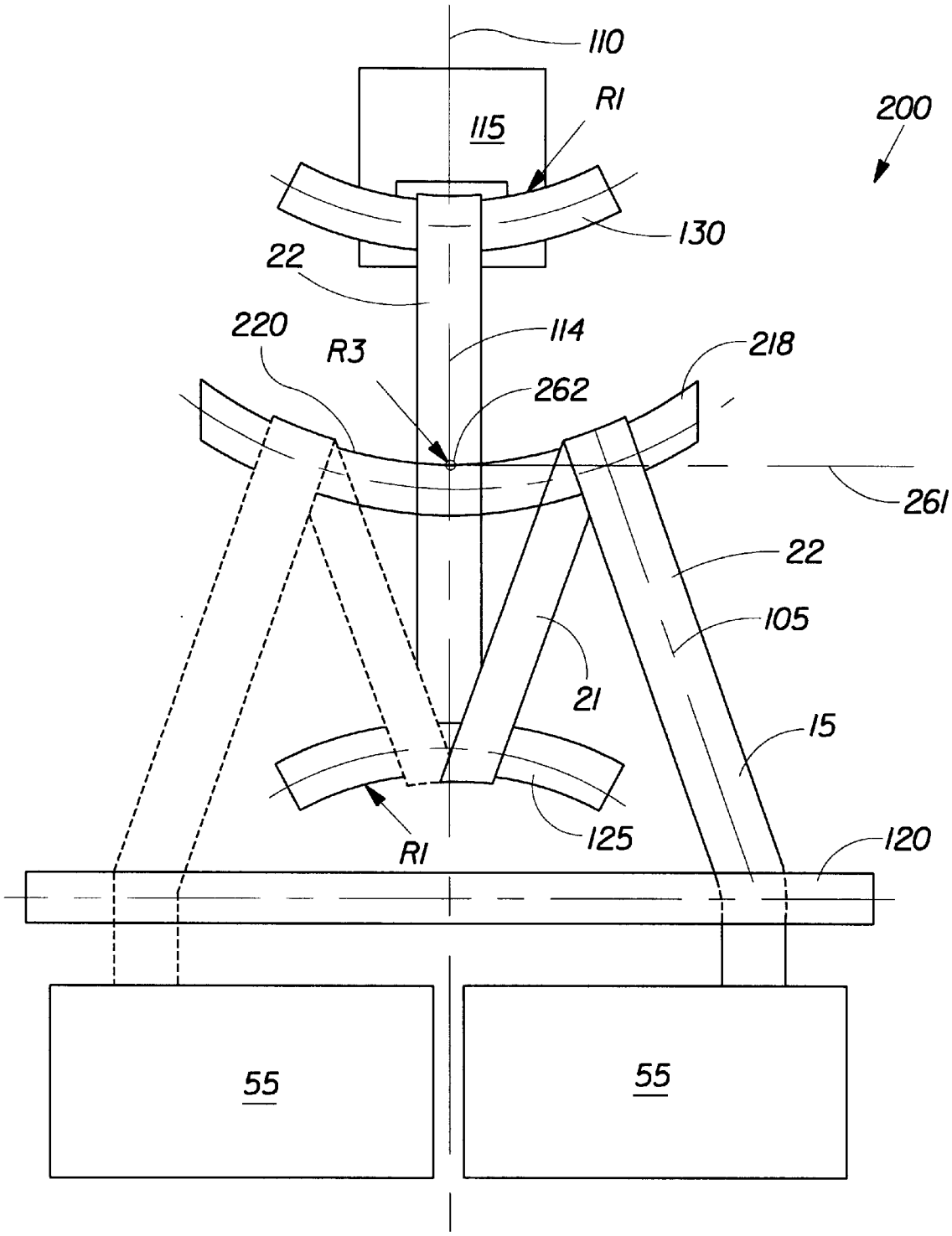
FIG. 8 is a simplified front elevational view of the embodiment shown in FIG. 7.
Figure 9:
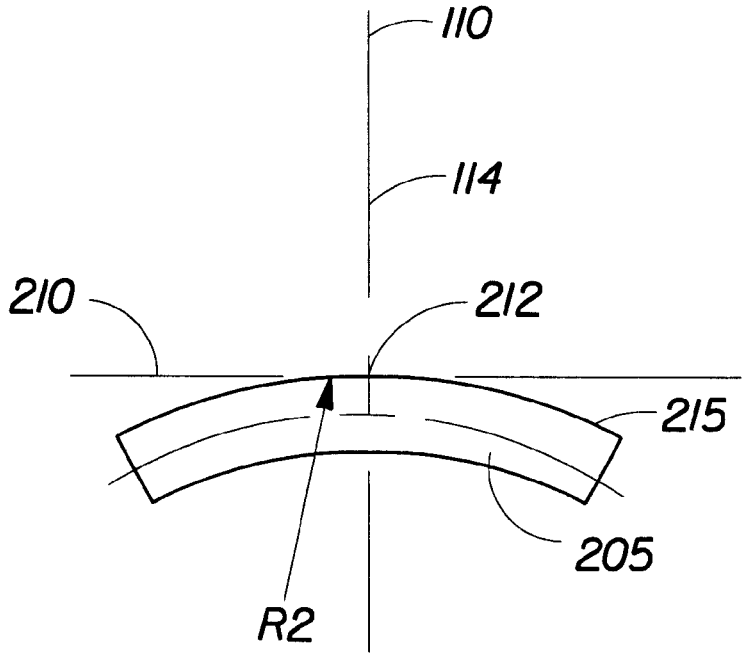
FIG. 9 is a partial top view of a stabilizing guide shown in FIG. 7.
Figure 10:
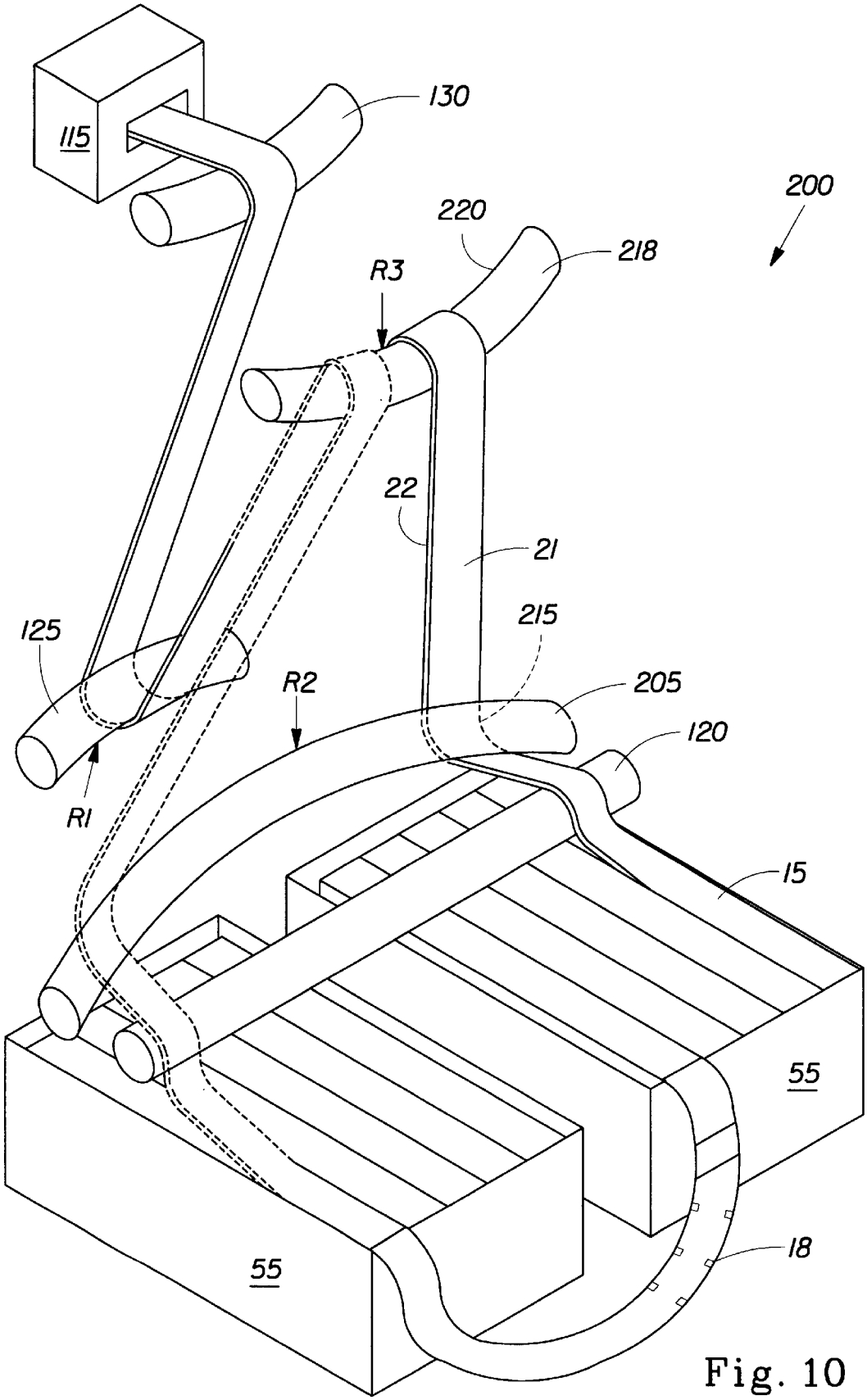
FIG. 10 is a simplified perspective view of the embodiment shown in FIGS. 7–9.

Another embodiment of the present invention is apparatus 200 shown in FIGS. 7–10. In addition to the guides 120, 125 and 130 of the apparatus 100, the apparatus 200 additionally includes a stabilizing guide 205 for preventing twisting of the web 15 after the input guide 120 and a pre-centering guide 218 for aligning the web 15 to the centering guide 125. Thus, it may be advantageous to employ the apparatus 200 when it is desirable to provide more reliable alignment of the web 15 than the apparatus 100 (of FIGS. 3–6). At least a portion of the stabilizing guide 205 has a stabilizing guide convex portion 215. The second surface 22 of the web 15 is preferably wrapped around the stabilizing guide convex portion 215 creating a frictional force between the web 15 and the stabilizing guide convex portion 215. The location of the stabilizing guide 205 can be varied with respect to the input guide 120 and it can be anywhere in the web path 135 as long as the stabilizing guide convex portion 215 is at least partially wrapped around by the second surface 22 of the web 15 and acts to guide the web 15 toward the entry point 115 of the converting line. Preferably, as shown in FIG. 9, the stabilizing guide 205 is positioned to intersect with the vertical projection 114 of the machine centerline 110 such that a tangent 210 to the stabilizing guide convex portion 215 at a point 212 of intersection of the stabilizing guide convex portion 215 with the vertical projection 114 of the machine centerline 110, is perpendicular to the vertical projection 114.

The makeup of the stabilizing guide convex portion 215 can be similar in all or any aspects to the makeup of the input guide outer surface 145 described in detail above. Further, it should be noted that any part of the stabilizing guide 205 may be hollow or solid, and the stabilizing guide 205 can be attached to a frame or to another guide by any suitable means. In the embodiment 200 shown in FIGS. 7–10, when the web width is about 6 inches (152 mm), it has been found that a suitable stabilizing guide 205 may comprise a 5 inch (127 mm) PVC pipe having a convex portion 215 at a radius R2 of about 4500 mm to about 5000 mm and preferably of about 4750 mm. The radius R2 can be also expressed as a percentage of the web width. For example, for a web width of about 152 mm, the radius R2 may be from about 2960 percent to about 3290 percent of the web width, and preferably, about 3125 percent of the web width.

Referring to FIGS. 7–10, the apparatus 200 may include pre-centering guide 218 having a pre-centering guide concave portion 220. The location of the pre-centering guide 218 can be varied with respect to the stabilizing guide 205 and it can be anywhere in the web path 135 as long as the pre-centering guide concave portion 220 is wrapped around by the first surface 21 of the web 15 and acts to guide the web 15 toward the entry point 115 of the converting line. Preferably, as shown in FIG. 8, the pre-centering guide 218 is positioned to intercept with the vertical projection 114 of the machine centerline 110 such that a tangent 261 to the pre-centering guide concave portion 220 at a point 262 of intersection of the pre-centering guide concave portion 220 with the vertical projection 114 of the machine centerline 110, is perpendicular to the vertical projection 114.

The makeup of the pre-centering guide concave portion 220 can be similar in all or any aspects to the makeup of the input guide outer surface 145 described in detail above. Further, it should be noted that any part of the pre-centering guide 218 may be hollow or solid, and the pre-centering guide 218 can be attached to a frame or to another guide by any suitable means. In the embodiment shown in FIGS. 7–10, when the web width is about 6 inches (152 mm), it has been found that a suitable pre-centering guide 218 may comprise a 5 inch (127 mm) PVC pipe having a concave portion 220 at a radius R3 of about 2600 mm to about 3100 mm and preferably of about 2850 mm. The radius R3 can be also expressed as a percentage of the web width. For example, for a web width of about 152 mm, the radius R3 may be from about 1710 percent to about 2040 percent of the web width, and preferably, about 1875 percent of the web width.

Figure 11:
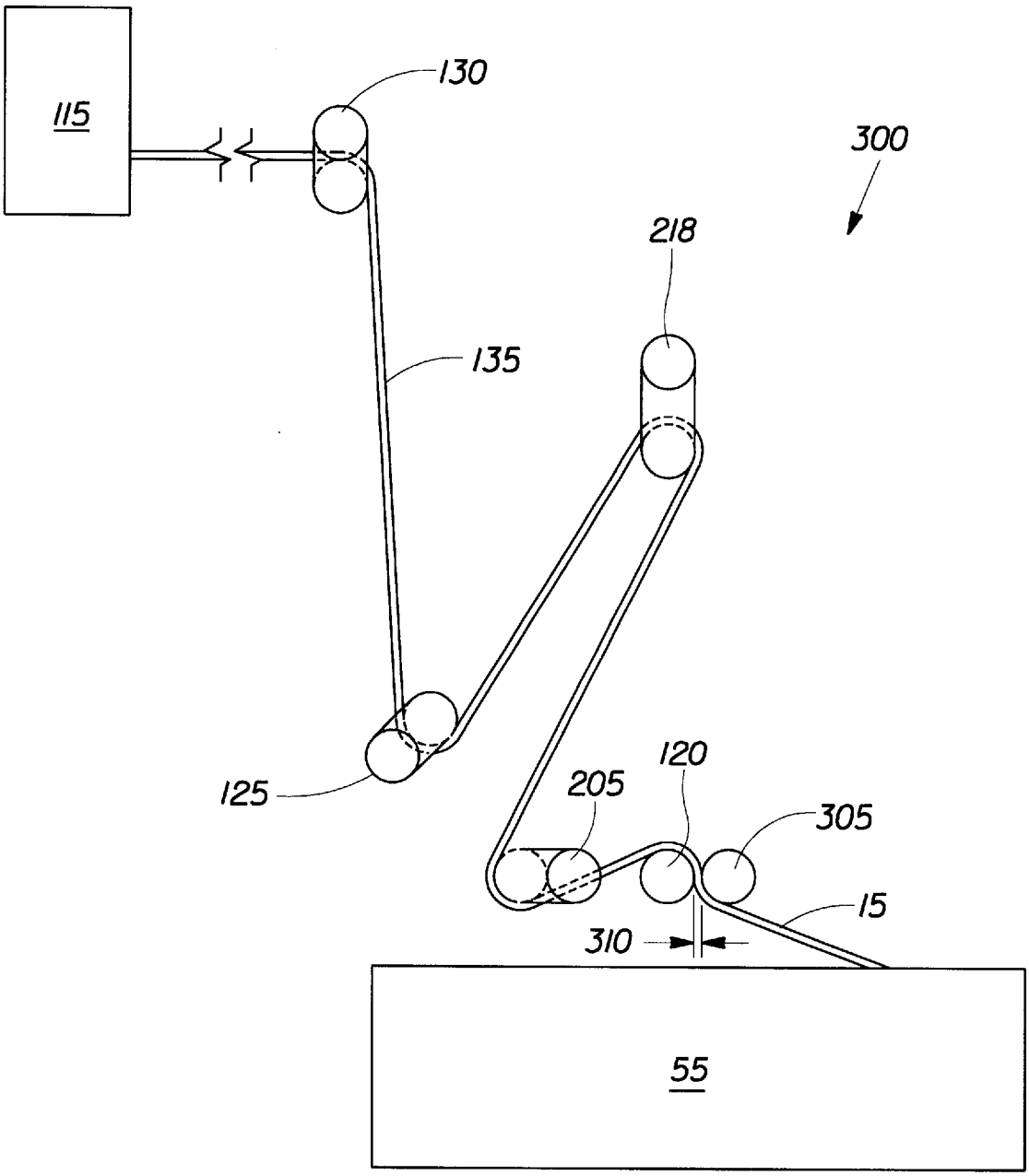
FIG. 11 is a simplified side elevational view of another embodiment of the present invention showing 6 guides.
Figure 12:
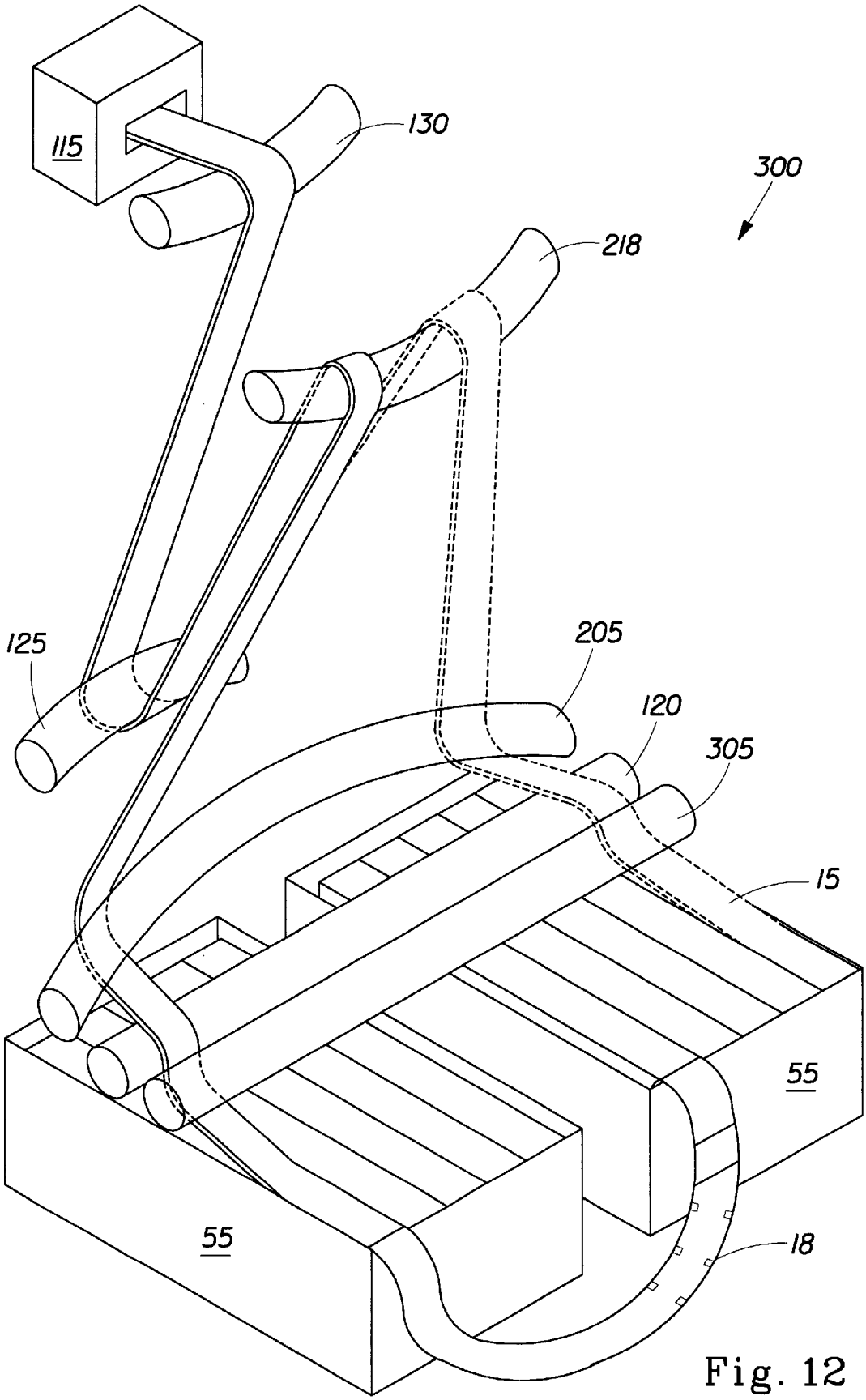
FIG. 12 is a simplified perspective view of the embodiment shown in FIG. 11.

Still another embodiment of the present invention is the apparatus 300 shown in FIGS. 11–12. The apparatus 300 may be similar to any of the previously described embodiments, but further includes an auxiliary guide 305 to prevent possible twisting of the web 15 prior to its wrapping around the input guide 120. The auxiliary guide 305 may be disposed generally parallel to the input guide 120 to create a physical gap 310 between the auxiliary guide 305 and the input guide 120 for accepting the web 15. The auxiliary guide can be similar in all or any aspects to the input guide 120 shown in FIGS. 3–6 and 7–10 for the apparatuses 100 and 200, respectively, and, therefore all above disclosure related to the input guide 120 is reiterated herein with respect to the auxiliary guide 305. The gap 310 can be of any size between 90 percent to 500 percent of the web thickness and/or between 1 percent to 100 percent of the web width. In the embodiment 300 shown in FIGS. 11–12, when the web width is about 6 inches (152 mm) and the web thickness of thicker part of the web is about 2 mm, it has been found that the gap 310 may be in the range of about 2 mm to 10 mm, preferably 5 mm. As with any of the other guides, the auxiliary guide 305 can be attached to a suitable frame or to another guide by any suitable means.

Figure 13:
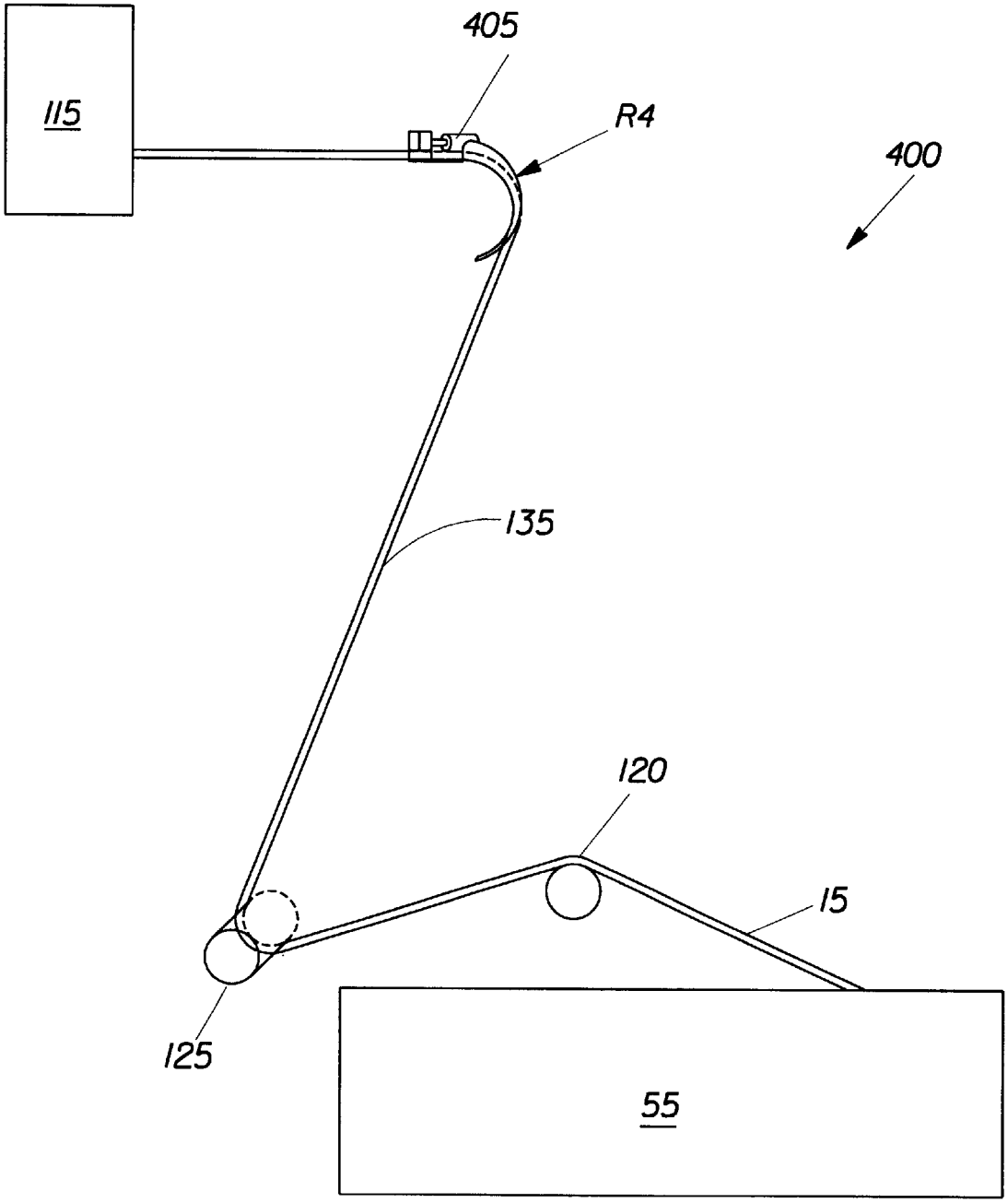
FIG. 13 is a simplified side elevational view of another embodiment of the present invention showing a combination guide.
Figure 14:
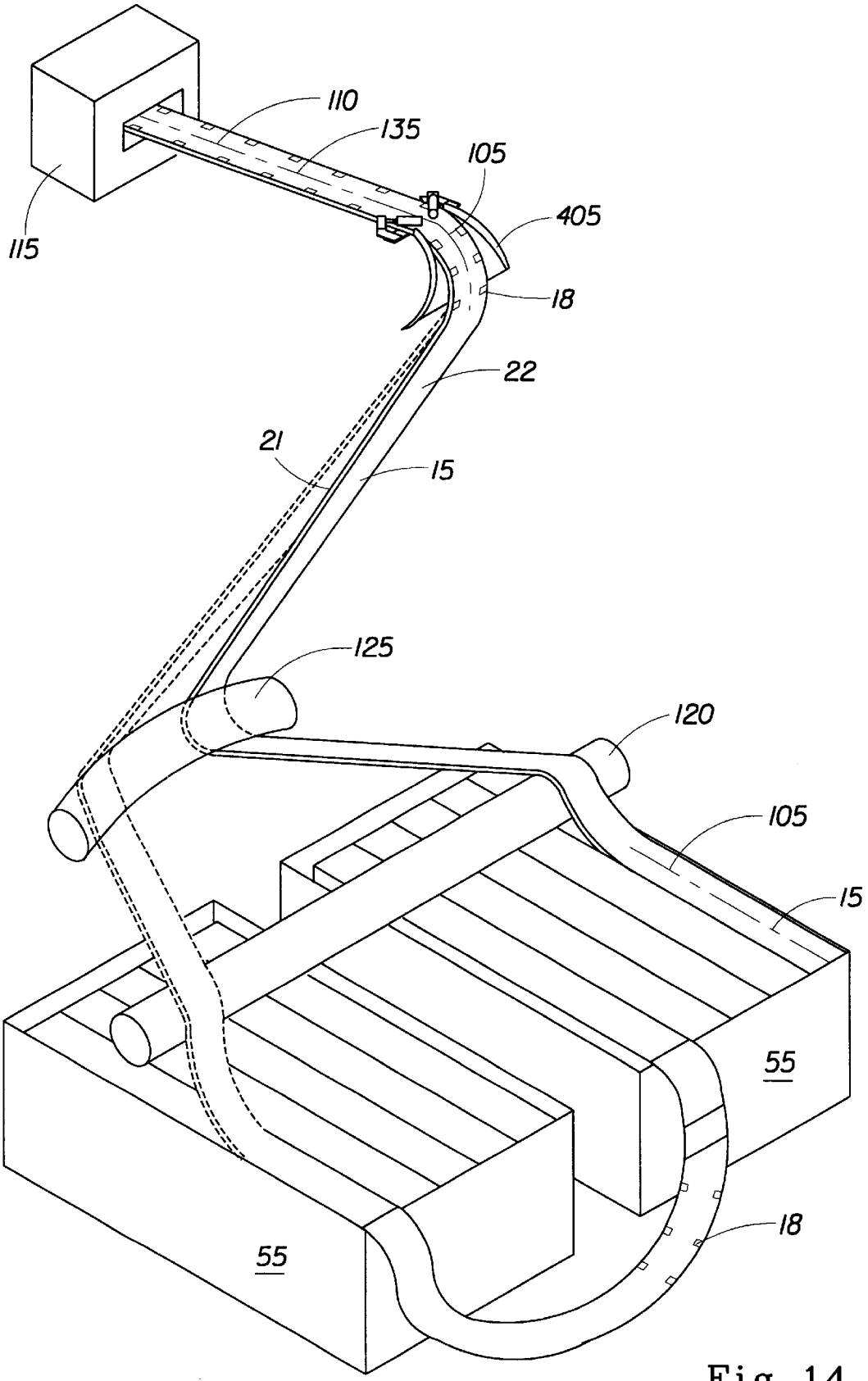
FIG. 14 is a simplified perspective view of the embodiment shown in FIG. 13.
Figure 15:
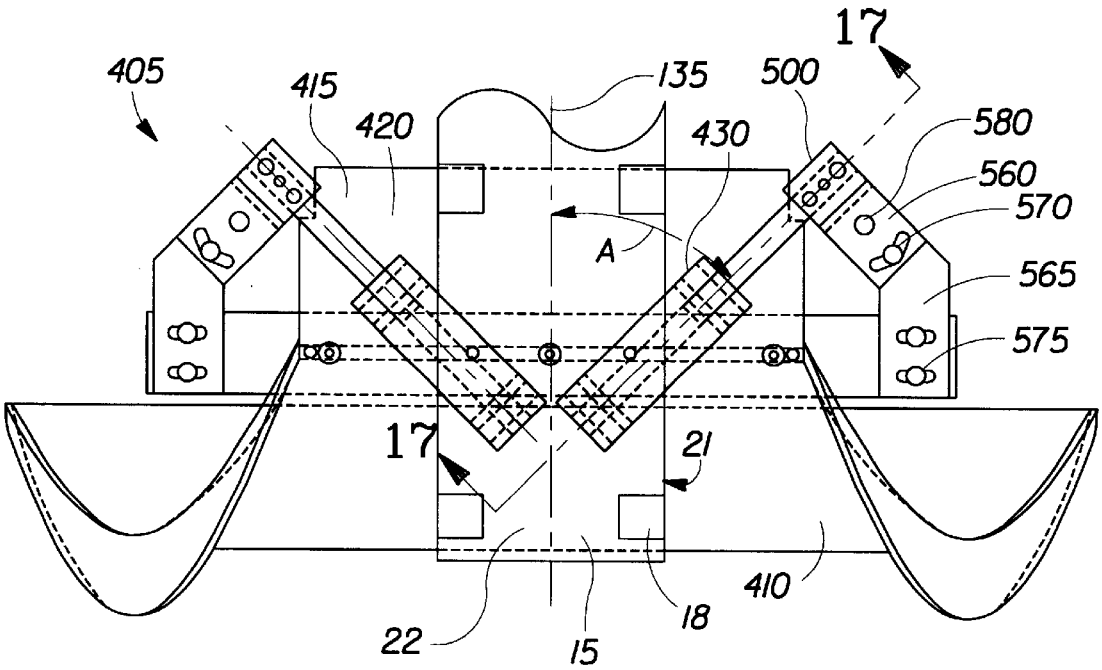
FIG. 15 is a simplified enlarged top view of the combination guide of the embodiment shown in FIGS. 13–14.
Figure 16:
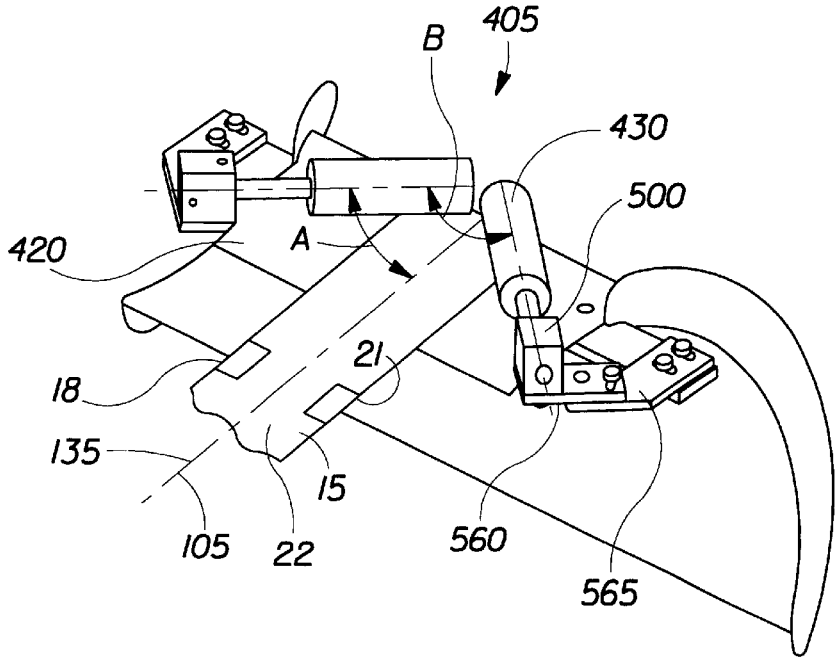
FIG. 16 is a simplified enlarged perspective view of the combination guide shown in FIG. 15 taken from the back.

Still another embodiment of the present invention is shown in FIGS. 13–14. The apparatus 400 is similar to the apparatus 100 (of FIGS. 3–6) in that it includes guides 120 and 125 of the apparatus 400. However, the apparatus 400 differs from the apparatus 100 in that it does not include the output guide 130 of the apparatus 100, but rather, includes a combination guide 405 which has a combination of two different surfaces. Referring to FIGS. 15–16, the combination guide 405 may include a combination guide first surface 410 and a combination guide second surface 415.

It is noted that both combination guide surfaces 410 and 415 may include various types of surfaces suitable to create a desired frictional force between the combination guide 405 and a particular web. The makeup of both combination guide surfaces 410 and 415 can be similar in all or any aspects to the make up of the input guide outer surface 140 shown in FIGS. 3–6 and described in detail above. In the embodiment shown in FIGS. 15–16, when the web width is about 6 inches (152 mm), it has been found that a suitable combination guide first surface may comprise a cylindrically shaped surface of a radius R4 from about 50 mm to 300 mm, and preferably 155 mm, and a suitable combination guide second surface may comprise a planar surface in a form of a plate 420 which may be attached to the combination guide first surface 410. It should be noted that the combination guide second surface 415 may be a separate part of the combination guide 405, or may be incorporated into a monolithic or a single-piece design of the combination guide 405.

Figure 17:
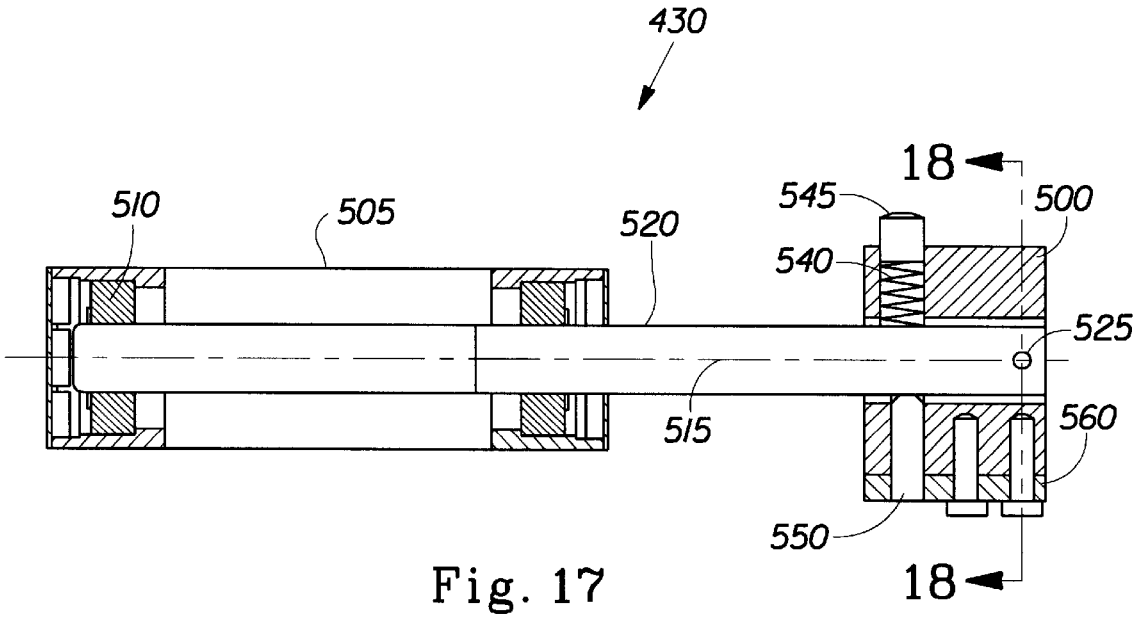
FIG. 17 is a simplified enlarged cross-section of a roll shown in FIGS. 15–16.
Figure 18:
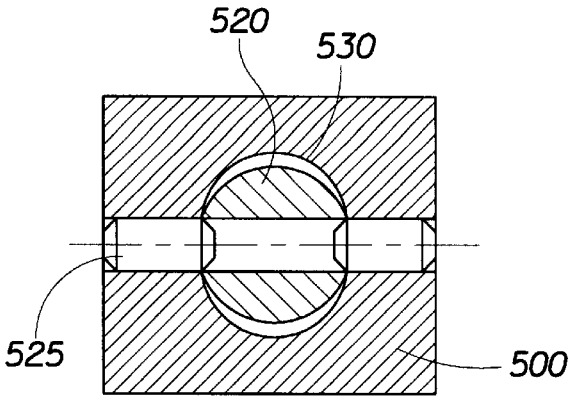
FIG. 18 is an enlarged cross-section of a holder taken through a pin shown in FIG. 17.

The combination guide 405 may further comprise at least one roll 430 disposed adjacent and substantially parallel to the combination guide second surface 415. The roll 430 can be any suitable roll of a suitable size and weight, and can be rotational or non-rotational. The roll 430 can be also any suitable surface having any suitable shape that is capable of providing a suitable resistance or frictional force between the web 15 and the combination guide second surface 415. FIGS. 15–16 show two rolls 430 which are disposed at an angle A to the longitudinal centerline 105 of the web 15. The angle A is preferably between about 30 degrees and about 60 degrees and more preferably about 45 degrees. One preferred embodiment of the roll 430 is shown in FIG. 17 wherein the roll 430 is held in a spring-loaded position in a holder 500. The roll 430 preferably includes a low-inertia idler roll which includes a light-weight cylinder 505 capable of rotating on bearings 510 around an axis 515 of a shaft 520 pivotally connected to pins 525 (best shown in FIG. 18) and, thereby, the shaft 520 is capable of moving in an elongated hole 530 of a holder 500. Spring 540 may be set in a compressed condition between the shaft 520 and a set screw 545, to thereby enable cylinder 505 to yield to thicker parts 18 of the web 15 which pass between the cylinder 505 and the combination guide second surface 415. The web 15 is thus pressed against the combination guide second surface 415 to provide a tension force to the web 15 which extends from the output guide 405 to the entry point 115 of the converter.

In any case, rolls 430 may be positioned at any desired gap between the combination guide second surface 415 by adjusting a set screw 550 (shown in FIG. 17) against the shaft 520. Further, the rolls 430 may be positioned at any suitable angle B(shown in FIG. 16) which may be of about 60 degrees to about 120 degrees and preferably of about 90 degrees between the axes 515 to provide an aligning function for the web 15. The angles A and B may be adjusted by any suitable means, including, for example, screws 570 and 575 and a pin 580 which may provide a pivot point for adjusting the holder 560 in relation to a bracket 565.

The location of the combination guide 405 can be anywhere on the web path 135 between the centering guide 125 and the entry point 115 as long as the combination guide first surface 410 is wrapped around at least partially by the first surface 21 of the web 15 and the combination guide second surface 415 is facing the first surface 21 of the web 15. Further, preferably, at least one roll 430 faces the second surface 22 of the web 15, and the combination guide 405 acts to guide the web 15 toward the entry point 115 of the converting line. It should be also noted that any part of the combination guide 405 may be hollow or solid, and the combination guide 405 can be attached to a frame or to another guide by any suitable means.

While particular embodiments and/or individual features of the present invention have been illustrated and described, it would be obvious to those skilled in the art that various other changes and modifications can be made without departing from the spirit and scope of the invention. Further, it should be apparent that all combinations of such embodiments and features are possible and can result in preferred executions of the invention. Therefore, the appended claims are intended to cover all such changes and modifications that are within the scope of this invention.

What is claimed is:

1. An apparatus for aligning a continuous web with a point of entry of a machine adapted to accept the web, the point of entry having a machine centerline, the web having a width, a longitudinal centerline, a first surface and a second surface, the apparatus comprising:

(a) an input guide having an input guide outer surface which is situated to intersect with the web extending from a web source structure toward the entry point of the machine, wherein the input guide outer surface is adapted to be at least partially wrapped by the first surface of the web when in use;

(b) a centering guide having a centering guide concave portion which is situated to intersect with the web extending from the input guide toward the entry point of the machine, wherein the centering guide concave portion is adapted to be at least partially wrapped by the second surface of the web when in use;

(c) an output guide having an output guide concave portion which is situated to intersect with the web extending from the centering guide toward the point of entry to the machine, wherein the output guide concave portion is adapted to be at least partially wrapped by the first surface of the web when in use;

(d) a stabilizing guide having a stabilizing guide convex portion which is situated to intersect with the web extending from the input guide towards the entry point of the machine, wherein the stabilizing guide convex portion is adapted to be at least partially wrapped by the second surface of the web; and (e) a pre-centering guide having a pre-centering guide concave portion which is situated to intersect with the web extending from the stabilizing guide toward the entry point of the machine, wherein the pre-centering guide concave portion is adapted to be at least partially wrapped by the first surface of the web.

2. The apparatus of claim 1 further comprising an auxiliary guide having an auxiliary guide convex portion which is disposed adjacent to the input guide convex portion to form a gap between the input guide and the auxiliary guide to prevent twisting of the web.

3. The apparatus of claim 1 wherein the centering guide concave portion intersects with a vertical projection of the machine centerline such that a tangent to the centering guide concave portion at a point of intersection of the centering guide concave portion with a vertical projection of the machine centerline is generally perpendicular to the vertical projection of the machine centerline.

4. The apparatus of claim 1 wherein the longitudinal centerline of the web disposed in the web source structure is not aligned with the machine centerline.

5. The apparatus of claim 4 wherein the web source structure has a width which is larger than the web width.

6. The apparatus of claim 5 wherein the web source structure is a traverse-wound roll or a festooned container.

7. The apparatus of claim 1 wherein the input guide is positioned adjacent to the web source structure.

8. The apparatus of claim 6 wherein the web in the festooned container has folds and the input guide is positioned generally parallel to the folds.

9. The apparatus of claim 6 wherein the traverse-wound roll has a rotational axes and the input guide is positioned generally parallel to the rotational axes.

10. The apparatus of claim 1 wherein the pre-centering guide concave portion intersects with a vertical projection of the machine centerline such that a tangent to the pre-centering guide concave portion at a point of intersection of the pre-centering guide concave portion with a vertical projection of the machine centerline is generally perpendicular to the vertical projection of the machine centerline.

11. The apparatus of claim 1 wherein the output guide concave portion intersects-with a vertical projection of the machine centerline such that a tangent to the output guide concave portion at a point of intersection of the output guide concave portion with a vertical projection of the machine centerline is generally perpendicular to the vertical projection of the machine centerline.

12. The apparatus of claim 1 wherein the stabilizing guide convex portion intersects with a vertical projection of the machine centerline such that a tangent to the stabilizing guide convex portion at a point of intersection of the stabilizing guide convex portion with a vertical projection of the machine centerline is generally perpendicular to the vertical projection of the machine centerline.

13. A method for aligning a continuous web with a point of entry of a machine adapted to accept the web, the point of entry having a machine centerline, the web having a web width, a longitudinal centerline, a first surface and a second surface, the apparatus comprising:

(a) wrapping the web at least partially about an input guide outer surface of an input guide such that the first surface of the web faces the input guide outer surface, wherein the input guide outer surface is situated to intersect a web path extending from the web source structure toward the entry point of the machine;

(b) wrapping the web at least partially about a centering guide concave portion of a centering guide such that the second surface of the web faces the centering guide concave portion, wherein the centering guide concave portion is situated to intersect the web path extending from the input guide to the entry point of the machine;

(c) wrapping the web at least partially about an output guide concave portion of an output guide such that the first surface of the web faces the output guide concave portion, wherein the output guide concave portion is situated to intersect the web path which extends from the centering guide toward the entry point of the machine;

(d) pulling the web from a web source structure toward the entry point of the machine;

(e) wrapping the web at least partially around a stabilizing guide convex portion of a stabilizing guide such that the second surface of the web faces the stabilizing guide convex portion, wherein the stabilizing guide convex portion is situated to intersect the web path which extends from the input guide to the entry point of the machine; and (f) wrapping the web at least partially around a pre-centering guide concave portion of a pre-centering guide such that the first surface of the web faces the pre-centering guide concave portion, wherein the pre-centering guide concave portion is situated to intersect the web path which extends from the stabilizing guide to the entry point of the machine.

* * * * *